US005555590A

United States Patent [19]

Blum et al.

[11] Patent Number: 5,555,590

[45] Date of Patent: Sep. 17, 1996

[54] TOOTH BRUSH

[75] Inventors: Alwin Blum, Bensheim; Matthias Georgi, Siegburg, both of Germany

[73] Assignee: Fuchs GmbH, St. Augustin, Germany

[21] Appl. No.: 515,362

[22] Filed: Aug. 15, 1995

[30] Foreign Application Priority Data

Sep. 28, 1994 [DE] Germany ..... 44 34 617.4

[51] Int. Cl.[6] ..... A46B 9/04

[52] U.S. Cl. ..... 15/167.1; 15/176.4; 15/176.5

[58] Field of Search ..... 15/167.1, 176.1, 15/176.4, 176.5, 176.6

[56] References Cited

U.S. PATENT DOCUMENTS

| | | | |
|---|---|---|---|
| 1,908,510 | 5/1933 | Dodson | 15/176.4 |
| 4,890,349 | 1/1990 | Nitzsche . | |
| 5,020,179 | 6/1991 | Scherer | 15/176.5 |
| 5,396,679 | 3/1995 | Brown | 15/167.1 |

FOREIGN PATENT DOCUMENTS

| | | | |
|---|---|---|---|
| 659812 | 2/1929 | France | 15/176.5 |
| 2311043 | 9/1974 | Germany | 15/176.4 |
| 3038895 | 8/1982 | Germany | 15/176.4 |
| 3345605 | 6/1985 | Germany | 15/167.1 |
| 91/09625 | 10/1991 | Germany . | |
| 6304021 | 11/1994 | Japan | 15/167.1 |
| 0377104 | 7/1932 | United Kingdom | 15/176.5 |

*Primary Examiner*—David Scherbel
*Assistant Examiner*—Randall E. Chin
*Attorney, Agent, or Firm*—Burns, Doane, Swecker & Mathis, L.L.P.

[57] ABSTRACT

A tooth brush including a handle and a replaceable bristle insert mounted in a recess formed at the front of the handle. The insert includes front and rear walls interconnected by side walls which taper toward the front wall. The recess of the handle is correspondingly shaped. Locking strips project from the front wall and both side walls of the insert for being snapped into corresponding locking grooves formed in the recess of the handle. Sections of each side wall of the insert and recess are smooth and free of locking strips and locking grooves to create a wedging or clamping action between the handle and insert.

4 Claims, 2 Drawing Sheets

TOOTH BRUSH

BACKGROUND OF THE INVENTION

The invention relates to a tooth brush with a replaceable bristle insert that can be snapped into an oblong mounting recess of a head part of the handle of the tooth brush. A release button of the bristle insert extends through an opening in the top wall of the mounting recess. Locking strips protrude from the bristle insert which engage in corresponding locking grooves formed in the mounting recess.

Tooth brushes of this kind, which are also called changeable head tooth brushes, are known in numerous embodiments. It is common for the connection between the bristle insert and the head part to take place via a locking connection. Desirably, the bristle insert should be anchored tightly in the head part when the tooth brush is used, so that it cannot be loosened unintentionally. Also, the locking connection should be easily releasable so that the bristle insert can be changed in a simple way without using any tools. In one known tooth brush (described in DE-GM 91 09 625), the bristle insert is shaped such that its side walls converge in the direction of the bristles. These side walls and the corresponding inner walls of the mounting recess are smooth and free of grooves. However, opposing front and rear ends of the insert are provided with locking connections formed by locking strips or locking protrusions which mate with locking grooves formed at ends of the recess. Since this locking connection engages at both ends of the bristle insert near to its outer surface on the bristle side, there is the danger that the locking connection might disengage on one end of the bristle insert and the bristle insert would be released from the head part when the head part is deformed. To avoid this, a relatively large undercut must be provided in particular on the locking connection of the handle to guarantee an interlocking mounting engagement. This has, on the other hand, the consequence that a relatively large deformation and thus a large force is required for releasing the bristle insert.

In another known tooth brush (described in DE-OS 30 38 895), locking strips are arranged on the side surfaces of the bristle insert in parallel and spaced relationship. Since the surrounding surface of the bristle insert runs along the entire perimeter perpendicular to the base surface of the bristle insert on the bristle side, the connection between the bristle insert and the head part takes place without a clamping action, i.e. only through the locking force being imposed on the locking strips.

Also, in a tooth brush of the type described in DE-PS 37 24 640, the peripheral surface of the bristle insert extends perpendicular to the base surface of the bristle insert, i.e., the base surface from which the bristles protrude. The anchoring of the bristle insert takes place exclusively by means of mounting strips, which extend for this purpose over a significant portion of the length of parallel side surfaces of the bristle insert. A locking groove accepting the locking strips extends around the entire inner perimeter of the mounting recess through which the contact surfaces are further reduced between the peripheral surface of the bristle insert and the mounting recess.

SUMMARY OF THE INVENTION

An object of the present invention is thus to create a tooth brush of the general type mentioned above, in which the advantages of a simple releasability of the bristle insert are combined with the advantages of a tight, secure connection between the bristle insert and the head part.

The problem is solved in that the bristle insert tapers along at least a substantial portion of its length toward the front end. In the tapering areas, smooth, uninterrupted sections are provided which engage corresponding smooth, uninterrupted sections of the inner wall of the mounting recess. Locking grooves are provided in the recess only in the area of corresponding locking strips found on the insert.

Due to the bristle insert tapering toward the front end, a wedge or clamp action is achieved, through which the bristle insert is held securely in the head part. This clamping action occurs on relatively large smooth, uninterrupted surface areas of the outer surface of the bristle insert, so that the insert is held securely when the head part is deformed during use.

Preferably, the outer surface of the bristle insert and the inner wall of the mounting recess extend mainly perpendicular to the base surface of the bristle insert. Thus, the wedge effect supporting the bristle insert occurs only in the longitudinal direction of the bristle insert; that does not impair the release of the bristle insert, because the locking button is situated in that area of the bristle insert in which the holding effect is caused largely only by the locking strips.

In accordance with the preferred embodiment of the invention, it is provided that the locking button is supported on the rear end of an opening formed in the top wall of the head. Consequently, the bristle insert is mounted elastically in its longitudinal (front-to-rear) direction, whereby the support on the locking button on one side and the side surfaces which taper in a wedge shape on the other side takes place. Since both of these support areas lie a sufficient distance from one another, the elastic resilience of the material situated in between affects the anchoring action favorably. In other words, the rear end of the bristle insert having the locking button is pressed into a wedge connection with the head part. The resulting flat interconnection, which is uninterrupted by strips or grooves, between the insert and the head part causes a secure support and connection. In accordance with an advantageous embodiment of the connection, it is provided that the brush insert has semi-circular ends, with a larger radius at the rear end. Linear sides converge toward the semi-circular front end.

BRIEF DESCRIPTION OF THE DRAWINGS

The objects and advantages of the invention will become apparent from the following detailed description of a preferred embodiment thereof in connection with the accompanying drawing in which like numerals designate like elements, and in which.

DETAILED DESCRIPTION OF A PREFERRED EMBODIMENT OF THE INVENTION

Figure 2:
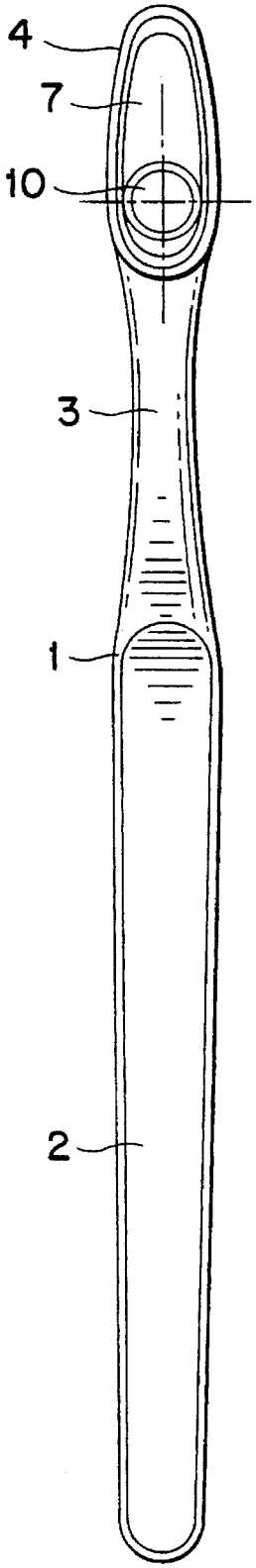
FIG. 2 shows a view of the tooth brush in accordance with FIG. 1 in the direction of arrow II, but with the bristle insert removed.
Figure 1:
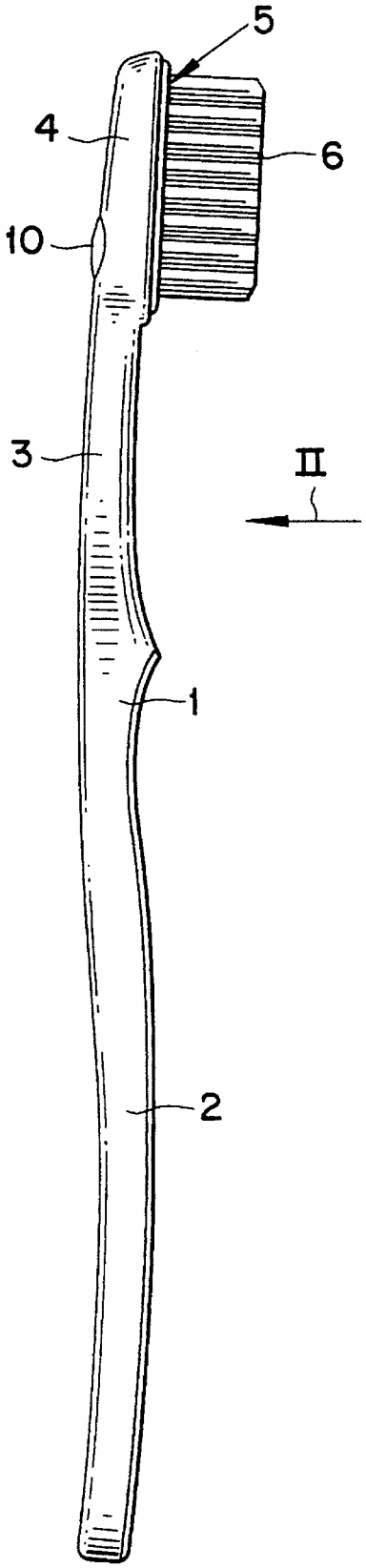
FIG. 1 shows a tooth brush from a side view.

The tooth brush shown in FIG. 1 has a handle 1 which is formed as a single piece from plastic to form a gripping portion 2, a stem 3 and a head part 4. In the head part 4, a replaceable bristle insert 5 is removably held, which insert carries bristles 6. The bristle insert 5 is set in a correspondingly shaped mounting recess 7 of the head part 4 such that it snaps in.

Figure 3:
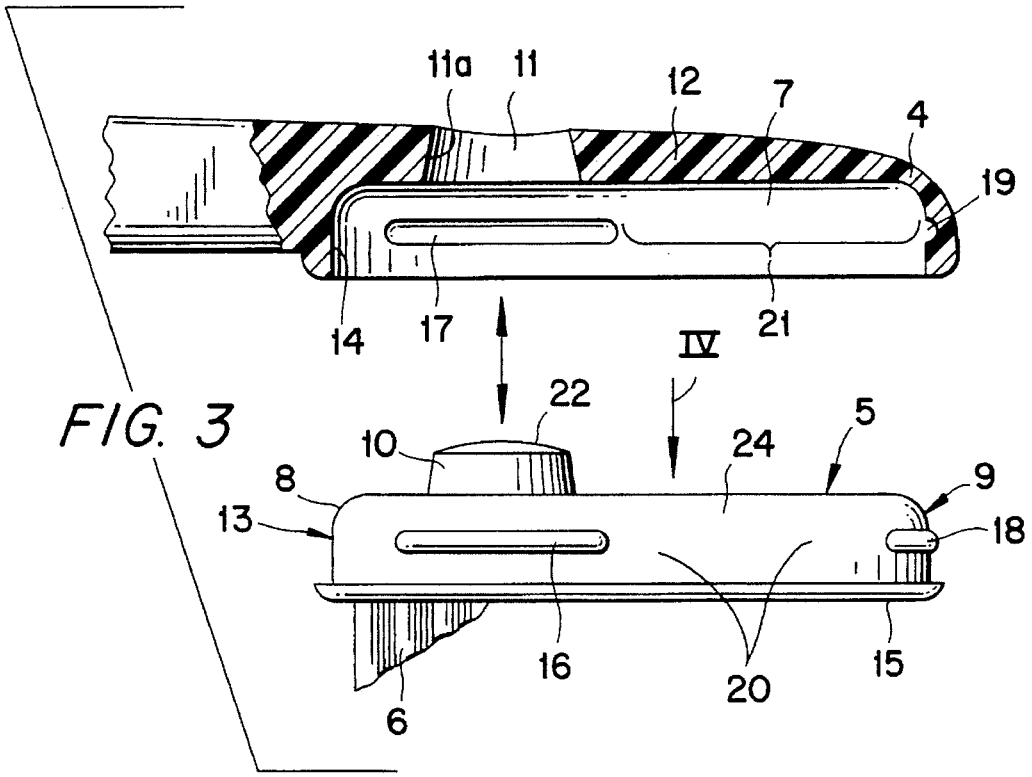
FIG. 3 is an exploded partial longitudinal section through the head part of the tooth brush in accordance with FIG. 1 with the bristle insert shown as removed.
Figure 4:
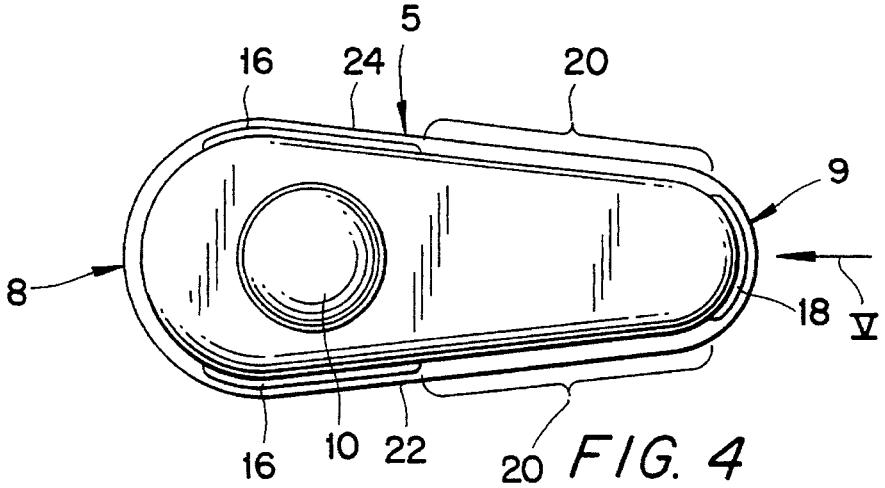
FIG. 4 shows a top view of the bristle insert in the direction of arrow IV in FIG. 3.
Figure 5:
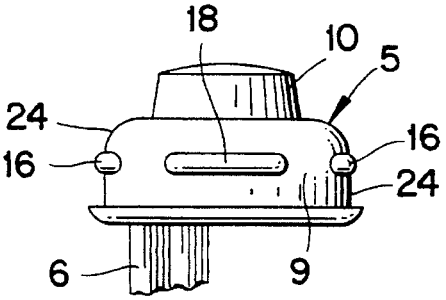
FIG. 5 shows a front view of the bristle insert in the direction of the arrow V in FIG. 4.

As can be seen in the details of FIGS. 3–5, the bristle insert 5 with bristles 6 is of oblong shape and extends from a broader rear end 8 to a narrower opposing front end 9.

The bristle insert 5 is made of plastic and provided with a release button 10 on its top side adjacent its rear end. The button 10 extends through an opening 11 in the top wall 12 of the head part 4 when the insert is installed. The button 10 and the corresponding opening 11 are offset in relation to a longitudinal center axis of the mounting recess 7 and are arranged near the rear or handle end of the mounting recess 7.

Locking strips 16, which engage in opposing locking grooves 17 of the inner wall 14 of the locking recess 7, protrude from the outer peripheral surface 13 of the bristle insert 5. The surface 13 extends substantially perpendicular to the base or bottom surface 15 of the bristle insert 5 on both sides of the button 10. The corresponding inner wall 14 of the mounting recess 7 also extends perpendicular to the surface 15 on both sides of the button. A front locking strip 18 disposed on the front end 9 of the bristle insert 5 engages in a front locking groove 19 provided in a front end of the inner wall 14 of the mounting recess 7. As can be seen particularly clearly in FIG. 4, the side walls 24 of the bristle insert 5 taper toward the front end 9. Side locking strips 16 are disposed on respective side walls 24 and are configured to snap into corresponding locking grooves 17 formed in corresponding side walls of the inner surface 14 of the recess 7. A section 20 of each side wall 24 of the insert 5 situated between the front locking strip 18 and a respective side locking strip 16 is smooth and free of locking strips. A corresponding section 21 of each side wall of the recess 7 is also smooth and free of locking grooves and extends parallel to a respective section 20.

When the insert 5 is installed, a preferably arched top surface 22 of the button 10 projects above the head part 4, as can be seen in FIG. 1, so that the bristle insert 5 can be released by a relatively light pressure on the arched outer surface 22 of the button 10. Alternatively, the arched surface 22 could lie flush with the outer surface of the head part. The installed bristle insert 5 is held securely in the head part 4 by a wedging or clamping action between the surface sections 20 and 21. Preferably, the dimensions of the bristle insert 5 and the head part 4 are selected so that the button 10 is supported on a rear end 11*a* of the opening 11 to act as a guide to ensure that the bristle insert 5 is pressed forwardly into a proper wedge-clamp position between the surface sections 20 and 21. The longitudinal forward shifting of the bristle insert 5 required for this does not impair the locking action between the locking strips 16, 18 and the corresponding locking grooves 17, 19. As can be seen in FIG. 4, the bristle insert 5 preferably has a semi-circular section with a larger radius on its rear end 8 as compared to the radius of the front end 9. Other tapering designs could also be selected.

The bristle insert 5 is fitted into the mounting recess 7 of the head part such that the front locking strip 18 initially engages in the locking groove 19, and then the rear end 8 is swivelled upwardly into the mounting recess to snap the locking strips 16 in the locking grooves 17.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A tooth brush comprising:

a handle forming a rear gripping portion and a front head part, said head part including an open, oblong mounting recess having front and rear end walls interconnected by side walls, substantial portions of said recess side walls tapering toward said front end wall, only one side locking groove being formed on each recess side wall, and a front locking groove being formed on said recess front end wall, a section of each recess side wall situated between said front locking groove and said respective side locking groove being substantially smooth and free of said locking grooves; and a bristle insert having bristles, said insert configured to be snapped into said recess, said bristle insert comprising front and rear end walls interconnected by side walls, substantial portions of said insert side walls tapering toward said insert front end wall, only one side locking strip being formed on each insert side wall, and a front locking strip formed on said insert front end wall, said side locking strips sized to snap into said respective side locking grooves, and said front locking strip sized to snap into said front locking groove, a section of each insert side wall situated between said front locking strip and said respective side locking strip being substantially smooth and free of said locking strips, said section of each insert side wall engaging said respective section of said recess to form a wedging action between said sections of said mounting recess and said bristle insert, said bristle insert including a release button projecting in a direction opposite said bristles and received in an opening formed in a wall of said head part, said button being situated closer to said insert rear end wall than to said insert front end wall.

2. The tooth brush according to claim 1, wherein said bristle insert includes a base surface from which said bristles project, said front end wall, rear end wall, and side walls of said bristle insert extending substantially perpendicularly to said base surface.

3. The tooth brush according to claim 1, wherein said opening in said wall of said head part includes a rear wall engaged by said button.

4. The tooth brush according to claim 1, wherein said front and rear end walls of said bristle insert are of semi-circular shape, a radius of said rear end wall of said insert being larger than a radius of said front end wall of said insert, said insert side walls extending linearly from said rear end wall to said front end wall.

* * * * *